US005399148A

United States Patent [19]

Waide et al.

[11] Patent Number: 5,399,148

[45] Date of Patent: Mar. 21, 1995

[54] EXTERNAL CARDIAC MASSAGE DEVICE

[75] Inventors: Michael J. Waide, North Ryde NSW; Patricia A. Waide, Merriwa NSW; Eric L. Cheminant, Miranda NSW, all of Australia

[73] Assignee: Baswat Holdings Pty. Ltd., Campbelltown, Australia

[21] Appl. No.: 971,918

[22] PCT Filed: Jul. 3, 1991

[86] PCT No.: PCT/AU91/00290

§ 371 Date: Dec. 31, 1992

§ 102(e) Date: Dec. 31, 1992

[87] PCT Pub. No.: WO92/00716

PCT Pub. Date: Jan. 23, 1992

[30] Foreign Application Priority Data

Jul. 6, 1990 [AU] Australia ..... PK1082

[51] Int. Cl.[6] ..... A61H 31/00

[52] U.S. Cl. ..... 601/41; 601/106; 601/108

[58] Field of Search ..... 417/510, 520; 601/41, 601/43, 44, 107, 108, 111, 106

[56] References Cited

U.S. PATENT DOCUMENTS

| | | | |
|---|---|---|---|
| 1,179,129 | 4/1916 | Maxam . | |
| 1,695,501 | 10/1925 | Opitz | 417/510 |
| 1,898,652 | 2/1933 | Williams . | |
| 2,222,811 | 11/1940 | Dinesen | 230/190 |
| 2,309,848 | 2/1943 | King | 50/16 |
| 2,336,526 | 7/1941 | Bristol | 417/505 |
| 2,965,117 | 12/1960 | Gallacher | 137/78 |
| 3,154,092 | 2/1961 | Conto | 417/505 |
| 3,160,486 | 12/1964 | Busch, Jr. | 55/162 |
| 3,209,748 | 10/1965 | Thomas | 128/28 |
| 3,234,934 | 2/1966 | Woodward | 128/53 |
| 3,364,924 | 1/1968 | Barkalow | 128/53 |
| 3,425,409 | 2/1969 | Isaacson et al. | 128/28 |
| 3,461,861 | 8/1969 | Barkalow et al. | 128/53 |
| 3,509,899 | 5/1970 | Hewson | 137/87 |
| 4,570,615 | 2/1986 | Barkalow | 128/28 |
| 4,664,098 | 5/1987 | Woudenberg et al. | 128/53 |
| 4,702,231 | 10/1987 | Arpin | 128/28 |
| 4,770,164 | 9/1988 | Lach et al. | 128/28 |

FOREIGN PATENT DOCUMENTS

| | | |
|---|---|---|
| 483402 | 5/1977 | Australia . |
| 1009576 | 11/1965 | United Kingdom . |
| 1187274 | 4/1970 | United Kingdom . |
| WO870784 | 12/1987 | WIPO . |

*Primary Examiner*—Robert A. Hafer
*Assistant Examiner*—David J. Kenealy
*Attorney, Agent, or Firm*—Christie, Parker & Hale

[57] ABSTRACT

An external cardiac massage device comprising a pressure source and a depressor means wherein pressure is transmitted from the pressure source to the sternum via the depressor means in a rhythmic fashion gradually increasing over time to a maximum then decreasing at a like rate while maintaining a minimum residual pressure on the sternum. Graph (A) shows variation in pressure on the sternum over time for ECM applied manually. Graph (B) shows variation in pressure applied by a prior art device. Graph (C) shows variation in pressure applied by a device according to the present invention.

6 Claims, 6 Drawing Sheets

EXTERNAL CARDIAC MASSAGE DEVICE

TECHNICAL FIELD

This invention relates to mechanical external cardiac massage devices suitable for use in a hospital or non-hospital setting.

BACKGROUND ART

The heart is a hollow muscular organ which lies in the chest cavity slightly left of the midline. By constant rhythmic contraction and dilation blood is kept circulating through the body. Heart function may fail due to a number of factors including coronary artery occlusion, commonly called heart attack, electric shock, drowning or asphyxia. In such situations external cardiac massage (ECM) is used to provide artificial blood circulation.

In ECM firm pressure is exerted on the lower half of the sternum, in order to compress the heart and major vessels between the sternum and the spine, resulting in cardiac output. The pressure needed vary from about 36 kgs to 55 kgs and the sternum should be depressed about 3.5 to 5 cm, varying from patient to patient. The cycle is repeated uniformly and smoothly at about 40–100 strokes per minute, allowing approximately equal time for depression and relaxation of the sternum.

The problems associated with manual ECM include fatigue to the operator, variation in the rate, force and duration of compressions, and limited facility for transportation and movement of the patient while ECM is being carried out. Further, inexperienced operators often cause injuries to the patient such as fractures to the ribs and sternum, lung damage, laceration to the liver or costochondral separation.

A number of mechanical devices have been developed with a view to overcoming the problems of manual external cardiac massage. However, these devices display a number of deficiencies.

There is a tendency for the sternum depressor to shift position on the sternum which leads to greater instances of rib and sternal fractures, liver laceration, lung damage and costochondral separation.

The complexity of prior art machinery or operating instructions leads to improper use or fitting of the device and thus to inadequate compression.

The ECM devices are often very heavy and cumbersome and require a relatively long time to set up, some as long as 4 minutes or more. Such a delay is excessive in emergency situations.

The prior art units are not entirely portable and tend to shift position from the sternum if the patient is transported up or down a stairway.

Many ECM devices use compressed gas cylinders as a power source, such a power source being heavy and cumbersome.

The pressure applied to the sternum during operation varies abruptly, alternating between mere contact with the patient to maximum compression, resulting in bruising and other injuries as described above.

DISCLOSURE OF INVENTION

The present invention is intended to overcome the disadvantages of the prior art or at least to provide a viable alternative.

Accordingly, the present invention provides an external cardiac massage device comprising a pneumatic pressure source and a depressor means, said depressor means being adapted to be secured against the sternum of a patient to alternately depress and release the sternum and maintain a minimum residual pressure to depress the sternum beyond its rest position, said pressure source being adapted to provide a minimum pressure equal to atmospheric pressure, said depressor means being connected to said pressure source such that pressure is transmitted from said pressure source to the sternum in a cyclic fashion gradually increasing over time in the first half of a cycle to a maximum pressure and decreasing at a like rate over the second half of a cycle.

A gradual increase and decrease of pressure on the sternum reduces trauma to the body. This combined with a residual pressure on the sternum mimics ideal manual ECM more closely than prior art devices. Unlike manual ECM the rate, force and duration of depression of the sternum will be constant. The pressure source may be any suitable source for generating the desired pressure pattern, preferably being portable and lightweight. A suitable pressure source is a compressor comprising a cylinder and piston driven by a motor means for reciprocal movement of the piston within the cylinder. The pressure source is connected to a depressor unit preferably via a flexible line.

The depressor means is adapted to be secured against the sternum of a patient and to exert pressure thereon. Contact with the sternum may be by way of a reciprocating block secured in place by support means. In a preferred embodiment, the support means include a flexible band connected to the reciprocating block for fastening around the chest of a patient and sprung support legs on either side of the block for additional stability and to enhance residual pressure on the sternum.

In another preferred embodiment the support means comprise a rigid adjustable frame.

The invention is now further described with reference to preferred embodiments as illustrated in the accompanying drawings.

MODES FOR CARRYING OUT THE INVENTION

Figure 1:
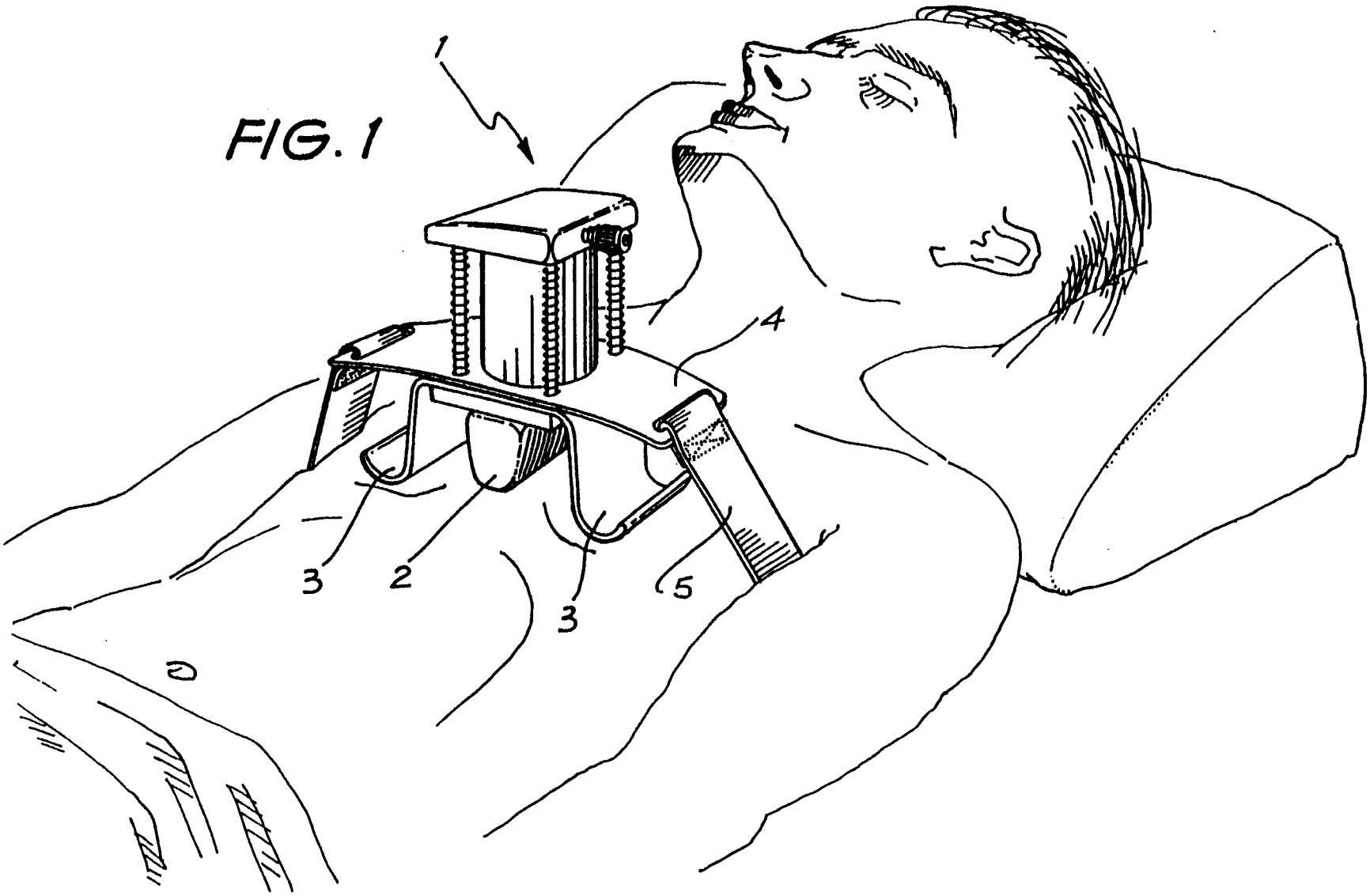
FIG. 1 shows a depressor unit secured in place above the sternum of a patient having flexible support.

It is noted that the same reference numerals are used to identify the same features in each figure.

FIG. 1 illustrates a depressor means generally indicated at (1) secured above the sternum of a patient. A reciprocating block (2) is in place on the sternum and is retained in position by support means comprising support legs (3), support plate (4) and a flexible band (5)

encircling the chest of the patient. The support legs are sprung so that when the flexible band is tightened around the chest, the support legs help to maintain residual pressure on the sternum. The flexible band may be textured on the under surface or may be inflatable to further secure the depressor means in correct position.

Figure 2:
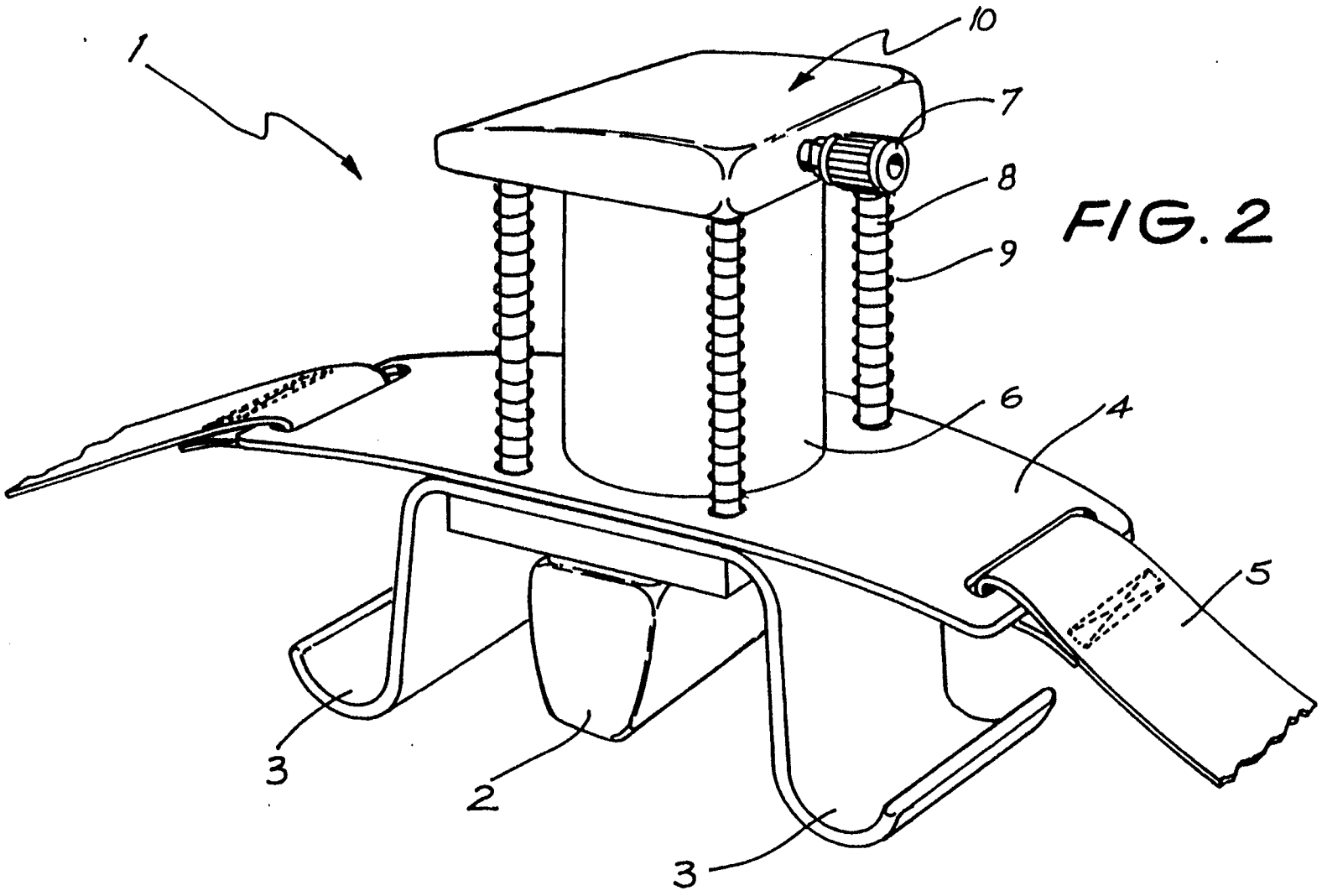
FIG. 2 is a perspective view of the depressor unit shown in FIG. 1.

FIG. 2 depicts the depressor means of FIG. 1. The reciprocating block (2) extends through the support plate (4) into a depressor cylinder (6) in a piston-like arrangement for reciprocal movement within the cylinder. The block is operated by pressure through a pressure line (not shown) removably connected at (7). The depressor cylinder is supported on the support plate (4) by bolts (8). If necessary, operation of the depressor means may be manually overridden by application of pressure to a hand block (10) on the depressor cylinder. During manual operation, the decompression stroke of the depressor cylinder is facilitated by optional return springs (9).

To secure about a patient, the depressor means is placed on the chest of the patient with the block against the sternum, and the flexible strap then tightened about the chest.

Figure 3:
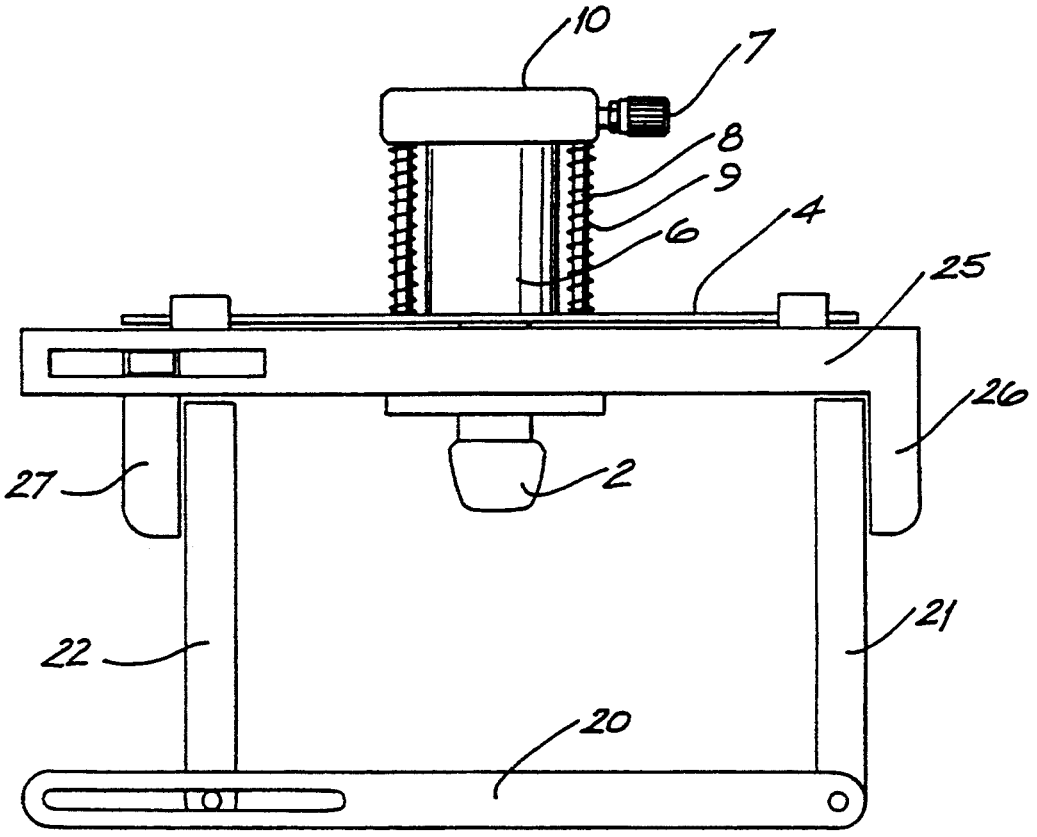
FIG. 3 is a side elevation of a depressor unit having rigid support.

FIG. 3 depicts a side elevation of a depressor means similar to that shown in FIG. 2 but having adjustable rigid support means. The support means comprise a base portion (20) having hinged arms (21, 22) at each end that are slidable relative to each other along the base portion and a top portion (25) having a support plate (4) slidably mounted thereon and having flanges (26, 27) at each end, slidable relative to each other along the top portion and adapted to engage the arms of the base portion.

In the embodiment shown, one arm (21) is hingeable about one end of the base portion (20) and the other arm (22) is hingeable about the other end of the base portion and slidable along the base portion. The top portion has a first flange (26) fixed and a second flange (27) slidable along the top portion. The support plate (4) to which is attached the block and cylinder (as shown in FIG. 2) is mounted on the top portion and slidable both longitudinally and laterally so that the block may be positioned above the sternum of a patient.

Figure 4:
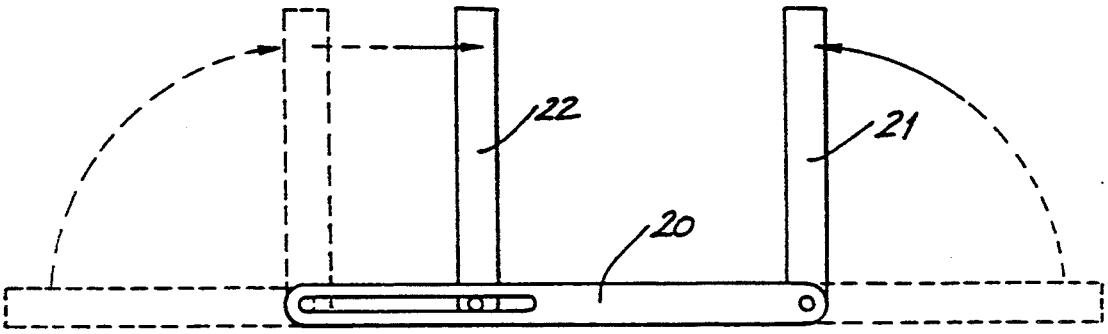
FIG. 4 is a portion of the depressor unit of FIG. 3.

To secure about a patient, the base portion is placed under the chest, the first arm is rotated to contact the side of the chest near the armpit and the second arm is rotated and slid along the base and fixed in position in contact with the other side of the chest near the armpit. In this regard, reference is made to FIG. 4 showing relative movement of the arms to the base portion. The top portion is then placed over the chest with the fixed flange engaging the first arm. The second flange is slid along the top portion and fixed in position engaging the second arm. The support plate is mounted on the top portion and adjusted to position the block on the sternum.

Figure 5:
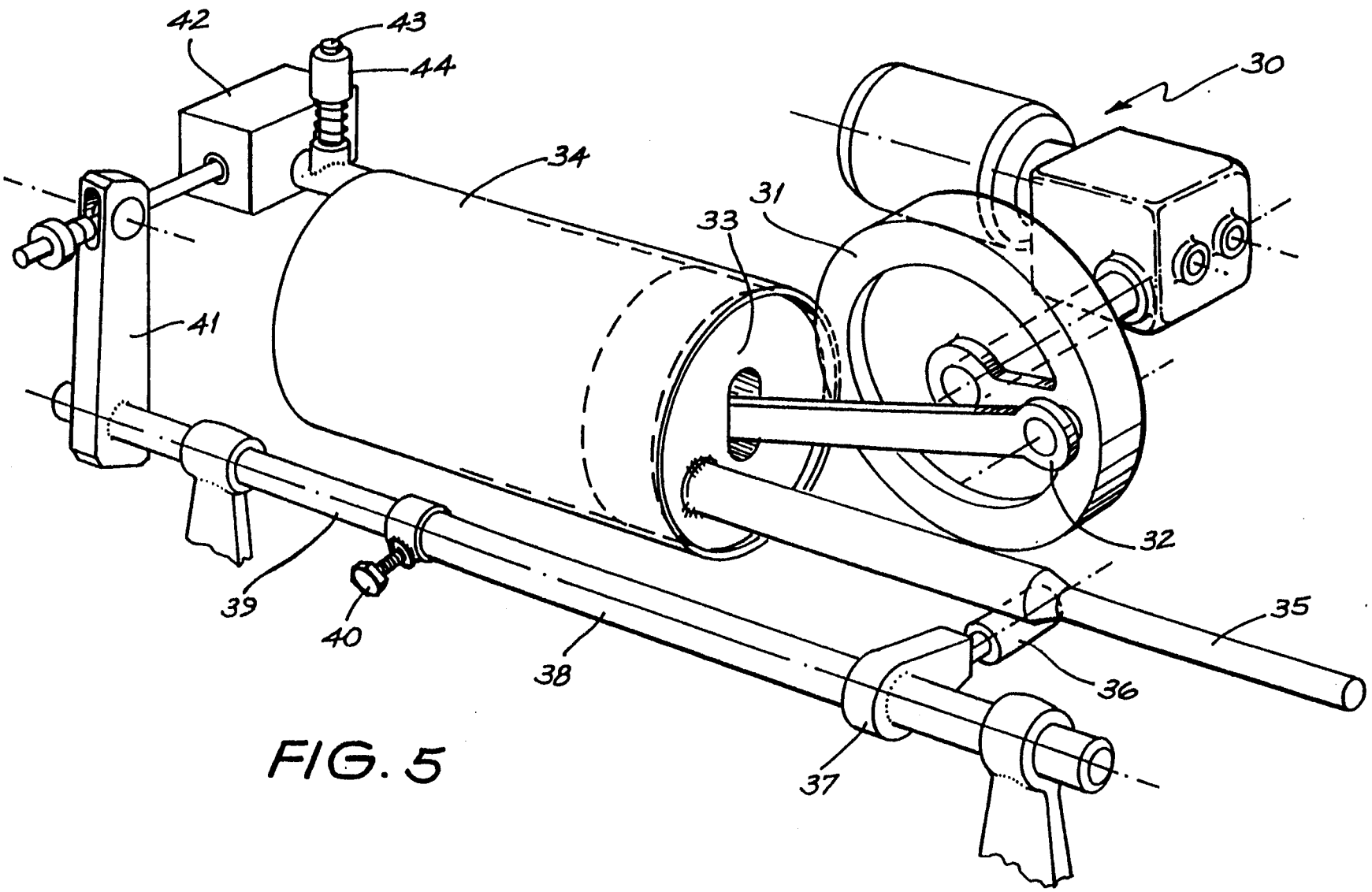
FIG. 5 is a perspective view of a motor means and compressor means of a first preferred embodiment.

FIG. 5 depicts motor means (30) pivotally connected via a flywheel crank (31) to a piston rod (32). The piston rod is pivotally connected to a piston (33) for reciprocal movement of the piston within a compressor cylinder (34). A cam rod (35) is fixedly connected to the piston and moves axially with it. The cam rod has a reduced portion remote from the piston. A lever roller (36) runs along the cam rod (35) as the piston moves in and out. The lever roller is attached axially to a lever (37) connected to a shaft (38). The end of the shaft (38) remote from the lever (37) fits into a rod (39) and can be moved along this rod (39) and locked into the desired position by use of thumbscrew (40). The rod (39) is connected to a lever (41) which operates a valve (42). The valve (42) is a two-way valve which may be opened either to the atmosphere or to a pressure line (not shown) attached at a point marked by reference number 43. A safety valve (44) is fitted at this point (43) to limit the maximum pressure that can be developed. The pressure line is removably connected to the depressor means (FIG. 2).

The axial position of the lever roller (36) in relationship to the movement of the cam rod (35) can be selected at any position along the stroke of the piston (33). As can be seen, on compression stroke of the piston (33) the lever roller (36) moves along the cam rod (35) to the reduced part of the cam rod. When the roller reaches the reduced part of the cam rod, lever (37) moves upwards and this slight rotation of the shaft (38) and rod (39) switches the valve (42) through lever (41) to connection with the depressor means (FIG. 2).

On decompression return stroke of the piston (33), the lever roller (36) moves from the reduced to the non-reduced portion of the cam rod (35). The resulting downward movement of the lever (37) rotates shaft (38) and rod (39) to switch the valve (42) through lever (41) to be open to the atmosphere.

The amount of air compressed in the cylinder and consequently the force applied by the block to the sternum is controlled by the position of the lever roller (36) relative to the compressor cylinder (34). Maximum force will be produced by positioning the lever roller (36) at the furthest position away from the compressor cylinder.

The motor means and compressor means of FIG. 5 are supported by a support frame (not shown). The motor means may be any suitable motor means. This preferred embodiment has a battery driven electric motor to enhance the portability of the device.

The number of strokes per minute induced in the depressor unit during operation may be adjusted by various methods known in the art. For example, where the motor means comprise a battery driven electric motor, a variable resistor between the battery and the motor would serve to regulate the number of strokes.

Figure 6:
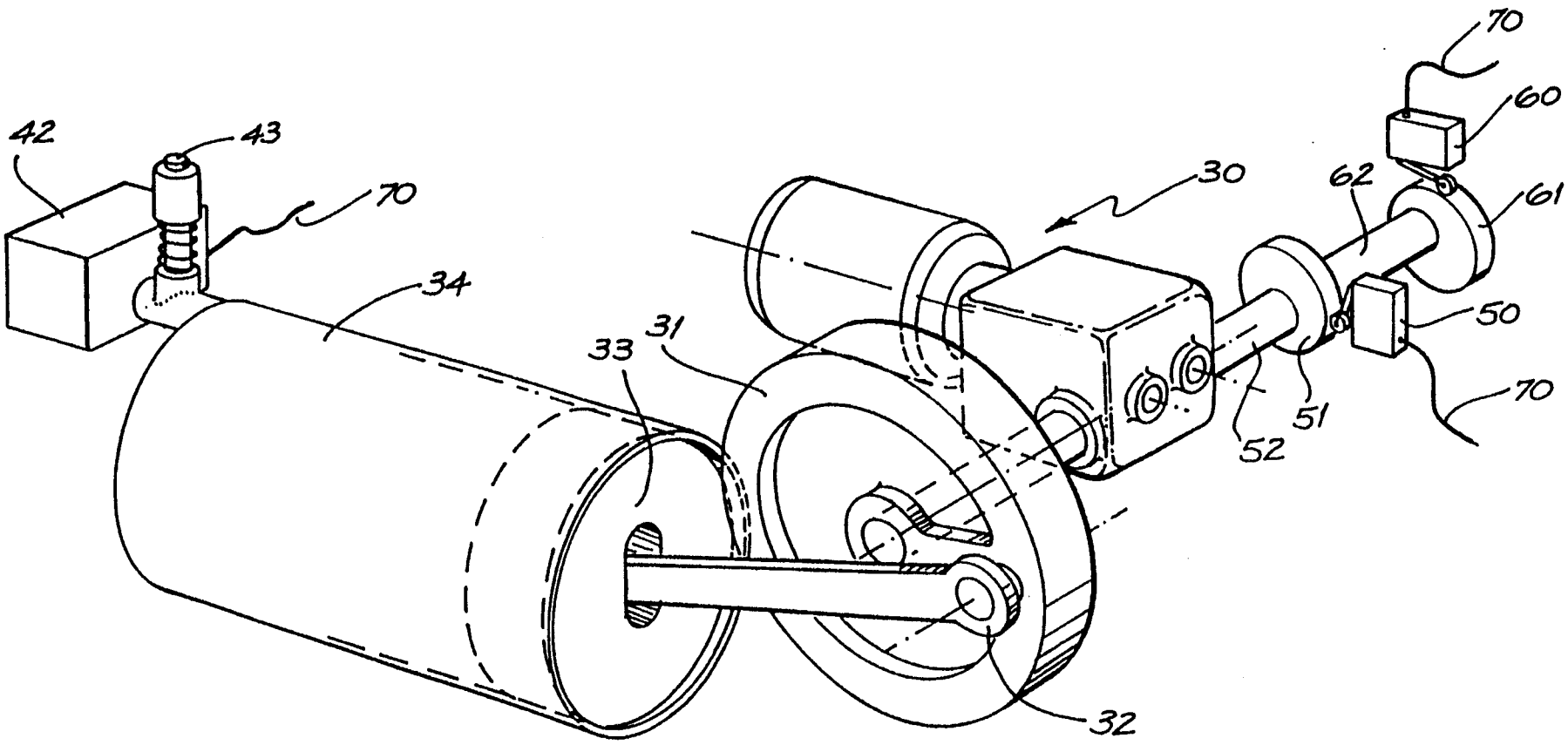
FIG. 6 is a perspective view of a motor means and compressor means of a second preferred embodiment.

The preferred embodiment of FIG. 6 depicts an electro-mechanically driven valve. As in FIG. 5, the motor means (30) is pivotally connected via a flywheel crank (31) to a piston rod (32). The piston rod is pivotally connected to piston (33) for reciprocal movement of the piston within a compressor cylinder (34). A two-way valve (42) may be opened either to the atmosphere or to a pressure line (not shown) attached at the point marked by reference numeral 43. The pressure line is removably connected to the depressor means (FIG. 2). The valve of this preferred embodiment is a solenoid operated latched valve requiring a pulse to open to the atmosphere and a pulse to open to the pressure line (close to the atmosphere). The pulses are provided by microswitches (50, 60). A first microswitch (50) is actuated by a cam (51) mounted on the same shaft (52) as the flywheel crank (31). This microswitch may be radially adjusted relative to the cam (51) to regulate the point on the compression stroke of the piston at which the valve is opened to the pressure line and therefore to regulate the pressure buildup in the cylinder (34). This in turn regulates the rate of force applied to the sternum by the depressor block. The earlier the valve is opened on the compression stroke, the more volume in the cylinder and the higher the force applied to the sternum.

A second microswitch (60) is actuated by a second cam (61) mounted on the shaft (62). The second switch is fixed so as to open the valve to the atmosphere at a predetermined point on the decompression return stroke of the piston. The microswitches (50, 60) are connected to the valve (42) by wires (70) in the usual way. The motor means and compressor means of FIG. 6 are supported by a support frame (not shown).

The number of strokes per minute induced in the depressor unit during operation may be adjusted by various methods known in the art.

It will be appreciated that other means known in the art may be employed to operate the two-way valve. Electric or electronic means may be used, such as a rotary encoder. Further other methods known in the art can be used to trigger external devices such as ventilators at a predetermined time.

To operate the ECM device, the depressor means is secured against the sternum of the patient as described above and connected to the compressor means via a flexible pressure line.

In the preferred compressor means shown in FIG. 5, the lever roller (36) is initially placed close to the compressor cylinder (34) and the motor is started. The lever is then moved away from the cylinder until the necessary depression of the sternum is achieved, at which point the thumbscrew (40) is tightened. The motor is set to the desired stroke rate and external cardiac massage begins.

In the compressor means of the preferred embodiment shown in FIG. 6, the motor is started and the position of the first microswitch is adjusted to give the desired residual pressure applied to the sternum. The stroke rate is set on the motor and external cardiac massage begins.

Figure 7:
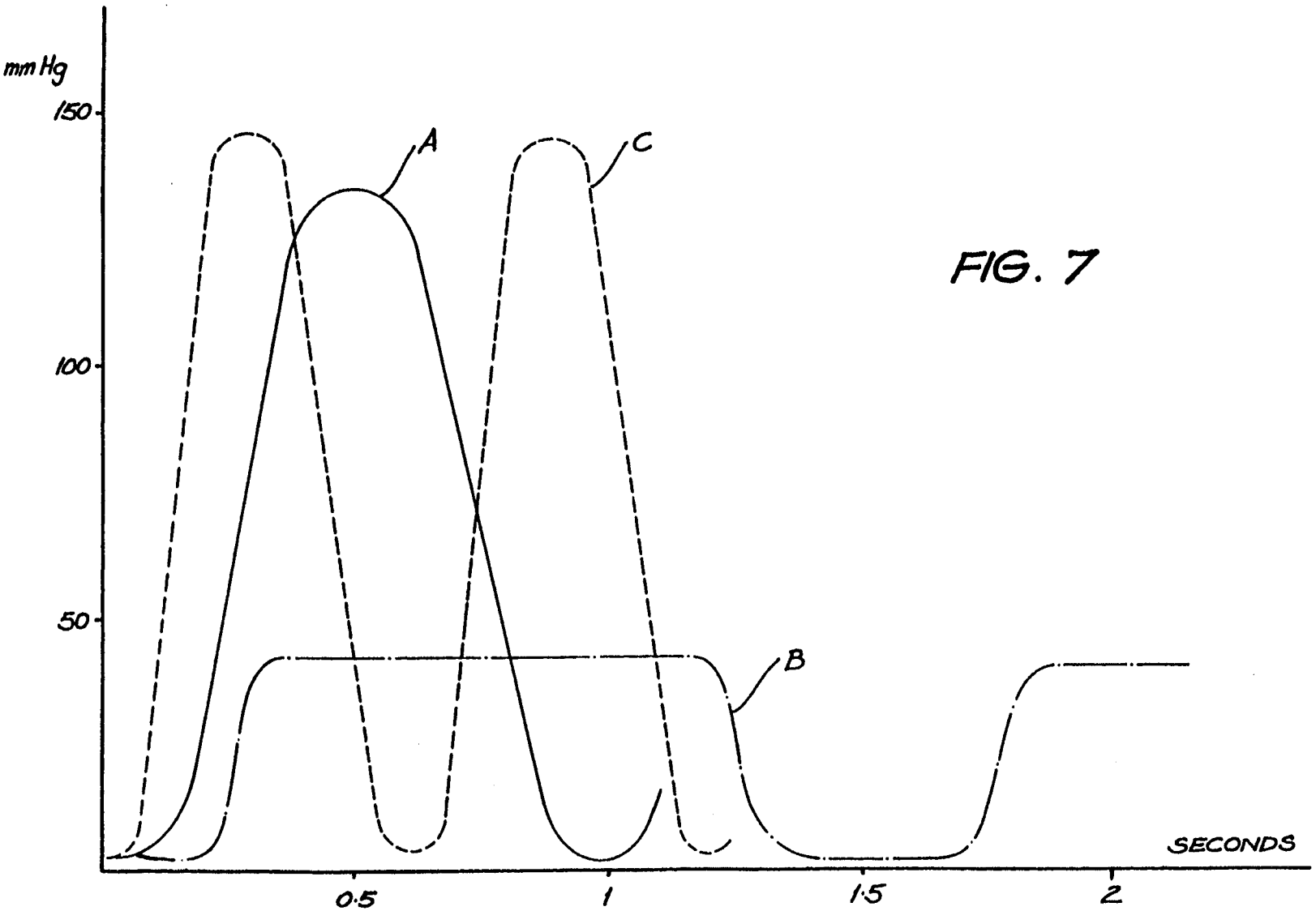
FIG. 7 is a graph of pressure versus time showing pressure on the sternum of a simulator dummy as applied by (A) manual ECM applied by a skilled operator, (B) a prior art ECM device, and (C) a device according to the present invention.

In FIG. 7, graph (A) indicates typical pressure against time applied by a skilled operator applying manual ECM. The graph shows a rhythmic gradual increase in pressure over time to a maximum point then a gradual decrease. The pressure does not decrease to zero, a minimum residual pressure is maintained. This results in an effective compression of the heart with minimum risk of physical injury to a patient. Graph (B) shows the pressure curve of a prior art device set to switch valve (42) partway through each compression and depression stroke. Graph (B) shows an abrupt increase from minimum to maximum pressure and abrupt drop to minimum pressure. Graph (C) shows a more powerful device according to the present invention running without slippage, that is with valve (42) fixed open to the depressor means, at maximum pressure. The pressure is applied in a rhythmic fashion similar to manual ECM.

The device has a set-up time of under two minutes. In an emergency situation the shortest possible set-up time is desirable. Ideally, ECM should begin as soon as natural heart function fails.

INDUSTRIAL APPLICABILITY

The external cardiac compression device of the present invention is suitable for use in a hospital or non-hospital setting. It may be employed in a wide variety of locations where emergencies arise. It is also suitable for use by ambulance and rescue workers.

It will be recognised by persons skilled in the art that numerous variations and modifications may be made to the invention as described above without departing from the spirit or scope of the invention as broadly described.

We claim:

1. An external cardiac massage device comprising a pneumatic pressure source, a valve switch means, and a depressor means, said pneumatic pressure source including a compressor means comprising a cylinder and piston reciprocally movable therein for providing a minimum pressure equal to atmospheric pressure, said depressor means including a reciprocating block adapted to be secured against the sternum of a patient for alternately depressing and releasing the sternum, yet maintaining a minimum residual pressure to depress the sternum beyond its rest position, a valve switch means connecting said depressor means to said pressure source for cyclically transmitting pressure from said pressure source to the depressor means for gradually increasing pressure to the depressor means over time in the first half of a cycle to a maximum pressure and decreasing at a like rate over the second half of a cycle, said valve switch means being located intermediate said compressor means and said depressor means for switching said compressor means between said depressor means and the atmosphere such that, at an adjustable point of each compression stroke of said piston, said compressor means is switched to said depressor means and, at the same adjustable point of each decompression return stroke of said piston, said compressor means is switched to the atmosphere.

2. An external cardiac massage device according to claim 1 wherein said valve switch means comprises actuating means regulating the point on the compression stroke of the piston at which the valve is opened to the depressor means and regulating the point on the decompression return stroke of the piston at which the valve is opened to the atmosphere.

3. An external cardiac massage device comprising a pneumatic pressure source, a valve switch means, and a depressor means, said pneumatic pressure source including a compressor means comprising a cylinder and a piston reciprocally movable therein and for providing a minimum pressure equal to atmospheric pressure, said depressor means including a reciprocating block adapted to be secured against the sternum of a patient for alternately depressing and releasing the sternum, yet maintaining minimum residual pressure to depress the sternum beyond its rest position, a valve switch means for connecting said depressor means to said pressure source such that the pressure is transmitted from said pressure source to the sternum in a cyclic fashion gradually increasing over time in the first half of a cycle to a maximum pressure and decreasing at a like rate over the second half of a cycle, said valve switch means being located intermediate said compressor means and said depressor means and comprising a cam rod fixedly connected to said piston adjacent said piston rod and having a reduced portion remote from said piston, a valve-operating lever means connected to a roller contacting said cam rod at an adjustable position along said cam rod relative to said cylinder so as to define said adjustable points of the compression stroke and decompression return stroke such that, on the compression stroke of said piston, the roller passes from the non-reduced portion to the reduced portion of the cam rod, and the resulting movement of the lever means opens said valve to the depressor means and, conversely, on the decompression return stroke of said piston, the roller passes from the reduced to the non-reduced portion of the cam rod, and the resulting movement of the lever means closes the valve to the depressor means and opens the valve to the atmosphere.

4. An external cardiac massage device comprising a pneumatic pressure source, a valve switch means, and a depressor means, said pneumatic pressure source including a compressor means comprising a cylinder and a piston reciprocally movable therein and for providing a minimum pressure equal to atmospheric pressure, said depressor means including a reciprocating block adapted to be secured against the sternum of a patient for alternately depressing and releasing the sternum, yet maintaining a minimum residual pressure to depress the sternum beyond its rest position, valve switch means connecting said depressor means to said pressure source for cyclically transmitting pressure from said pressure source to the sternum for gradually increasing the pressure over time in the first half of a cycle to a maximum pressure and for decreasing the pressure at a like rate over the second half of a cycle, said valve switch means being located intermediate said compressor means and said depressor means and comprising first means for detecting a first rotational position of the piston rod and second means for detecting a second rotational position of the piston rod, the first and second means each including a microswitch and a cam, and linking means for connecting each cam to the piston rod, and the first and second means being radially adjustable to adjust the first and second rotational positions, wherein the valve switch means includes a means for opening the valve to the depressor means at a predetermined point of the compression stroke of the piston in response to a signal from the first means, and for opening the valve to atmosphere at the same predetermined point of the decompression return stroke in response to a signal from the second means.

5. An external cardiac massage device according to claim 4 wherein the depressor means comprises a reciprocating block for contacting the sternum of a patient and support means comprising support legs positioned on either side of said block and a flexible band for encircling the chest of a patient.

6. An external cardiac massage device according to claim 4 wherein the depressor means comprises rigid adjustable support means.

* * * * *